US005638966A

United States Patent [19]

Kuntz

[11] Patent Number: 5,638,966

[45] Date of Patent: Jun. 17, 1997

[54] FREE STANDING SHEET METAL BATHROOM SHELVES

[76] Inventor: Charles H. Kuntz, 2008 Mapleton St., Centerville, Ohio 45459

[21] Appl. No.: 685,360

[22] Filed: Jul. 24, 1996

[51] Int. Cl.[6] ..... A47F 7/00

[52] U.S. Cl. ..... 211/153

[58] Field of Search ..... 211/153, 90, 135, 211/105.1; 108/91, 27

[56] References Cited

U.S. PATENT DOCUMENTS

| | | | |
|---|---|---|---|
| 2,957,587 | 10/1960 | Tobin | 211/90 X |
| 4,577,751 | 3/1986 | St. Jacques | 211/90 X |
| 4,713,949 | 12/1987 | Wilcox | 211/153 X |

*Primary Examiner*—Alvin C. Chin-Shue
*Assistant Examiner*—Sarah L. Purol

[57] ABSTRACT

This disclosure is directed to a free standing (unattached) sheet metal shelf, requiring no tools to install instantly and combinations containing same. The sheet metal shelf is free standing because it is not attached to anything. It has a pair of depending support side leg portions terminating in arcuate bottom surfaces, which permit the sheet metal bathroom shelf to be self adjusting in a position so that its back portion rests against the bathroom wall and is aligned in relation therewith.

A method of forming this sheet metal shelf is also disclosed and described along with the combination of a magnet and aesthetically pleasing, e.g., wooden, top shelf secured on its bottom surface to the top of the sheet metal shelf and on its upper surface secured to the lower surface of the decorative, aesthetically pleasing, top shelf. The structure and method of assembling the various surfaces to permit an aesthetically pleasing, wooden upper surface is likewise illustrated and disclosed. The present invention is illustrated in the following drawings.

3 Claims, 3 Drawing Sheets

3
10
13
14
17
11
12
2
18
21
20
19
2
21
3

19
16
15
21
21

18
13
10

14
17
16
21
20

10
13
17
12
14
11
16

15

FREE STANDING SHEET METAL BATHROOM SHELVES

BRIEF DESCRIPTION OF THE INVENTION

This invention is directed to a free standing (unattached) sheet metal shelf, requiring no tools to install instantly and combinations containing same. The sheet metal shelf is free standing because it is not attached to anything. It has a pair of depending support side leg portions terminating in arcuate bottom surfaces, which permit the sheet metal bathroom shelf to be self adjusting in a position so that its back portion rests against the bathroom wall and is alined in relation therewith.

A method of forming this sheet metal shelf is also disclosed and described along with the combination of a magnet and aesthetically pleasing, e.g., wooden, top shelf secured on its bottom surface to the top of the sheet metal shelf and on its upper surface secured to the lower surface of the decorative, aesthetically pleasing, top shelf. The structure and method of assembling the various surfaces to permit an aesthetically pleasing, wooden upper surface is likewise illustrated and disclosed. The present invention is illustrated in the following drawings.

DETAILED DESCRIPTION OF THE INVENTION

Figure 1:
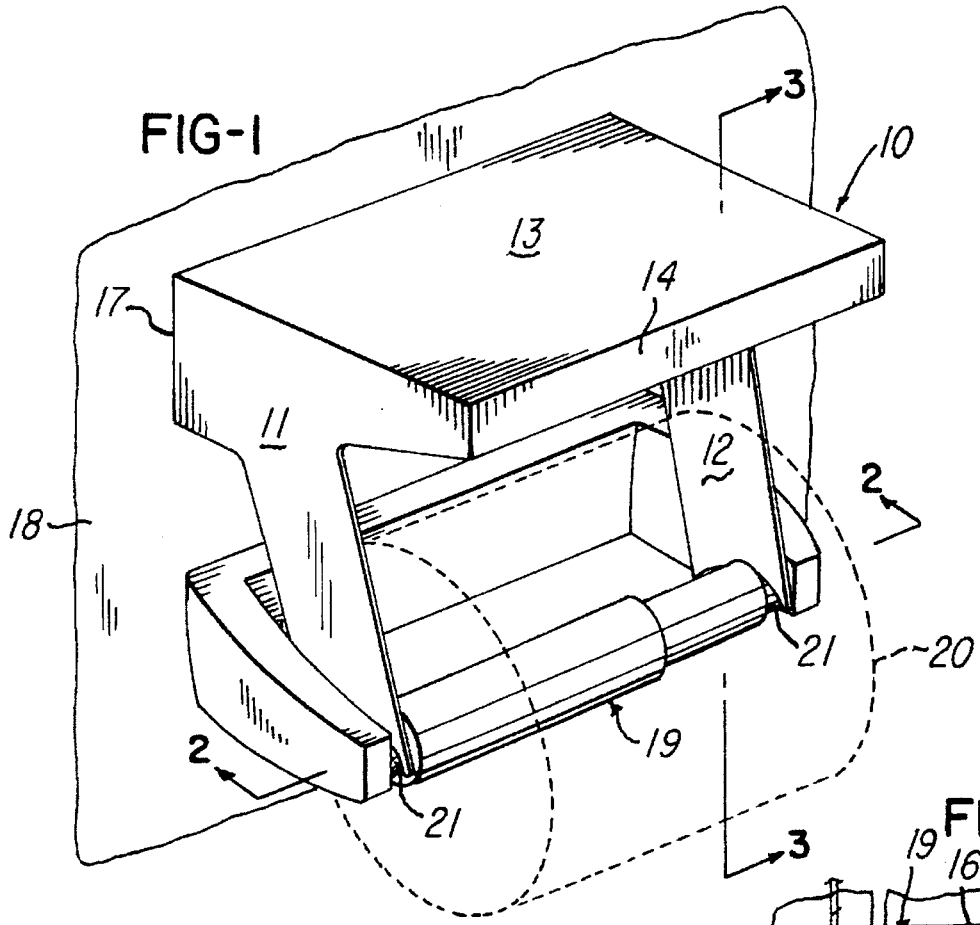
FIG. 1 of the drawings is a fragmentary perspective view of the sheet/metal shelf mounted on a toilet paper roller.

As will be apparent from FIGS. 1, 4, 7 and 11, free standing (unattached) sheet metal shelf 10 has depending support side leg portions (11) and (12), top portion (13) and front wall portion (14).

Side wall portions for (11) and (12) each have respective self-adjusting upward bottom surfaces (15) and (16).

As it is apparent from FIGS. 3 thru 8 and 12 the free standing sheet metal shelf has a rear wall portion (17), which rests upon and is aligned with, bathroom wall (18) as is shown in FIGS. 1, 3, 11 and 12.

Figure 2:
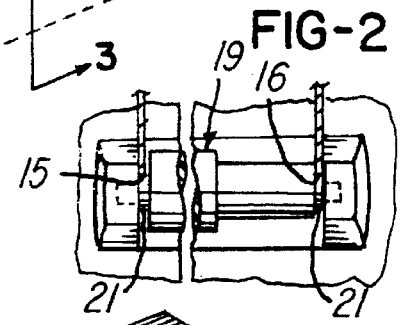
FIG. 2 of the drawings is a fragmentary view taken along lines 2—2 of FIG. 1 with parts broken away and parts in section.
Figure 10:
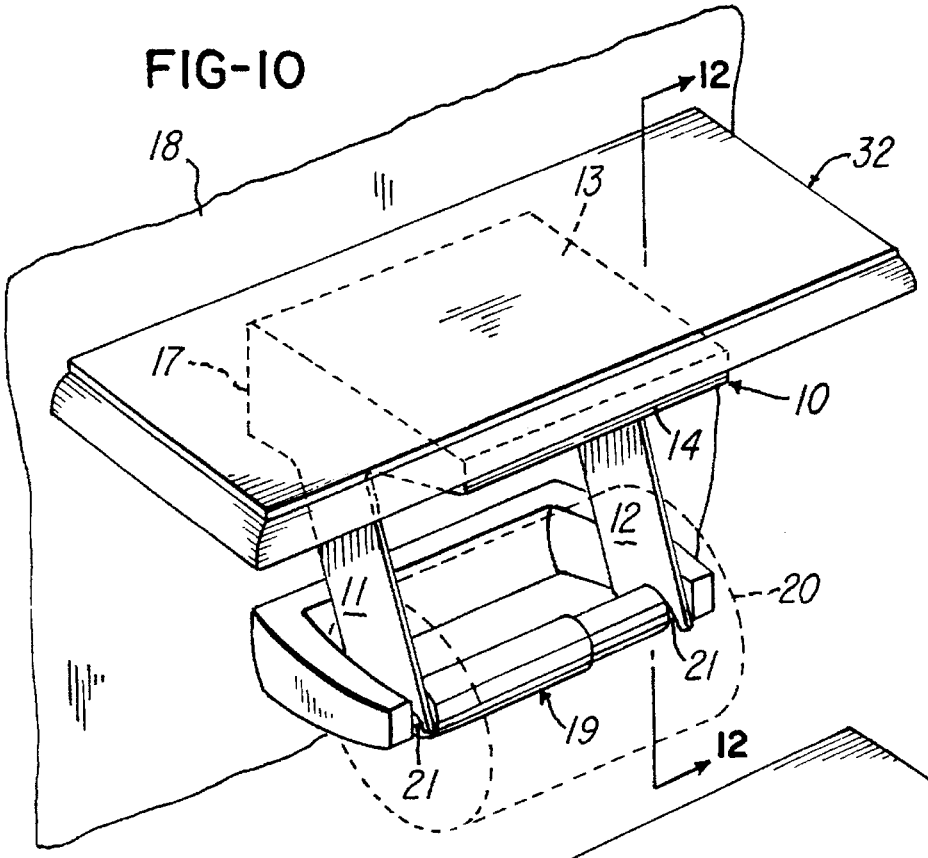
FIG. 10 is a fragmentary perspective view similar to that of FIG. 1, showing a decorative, e.g., wooden, shelf attached to the top of the sheet metal shelf.
Figure 10:
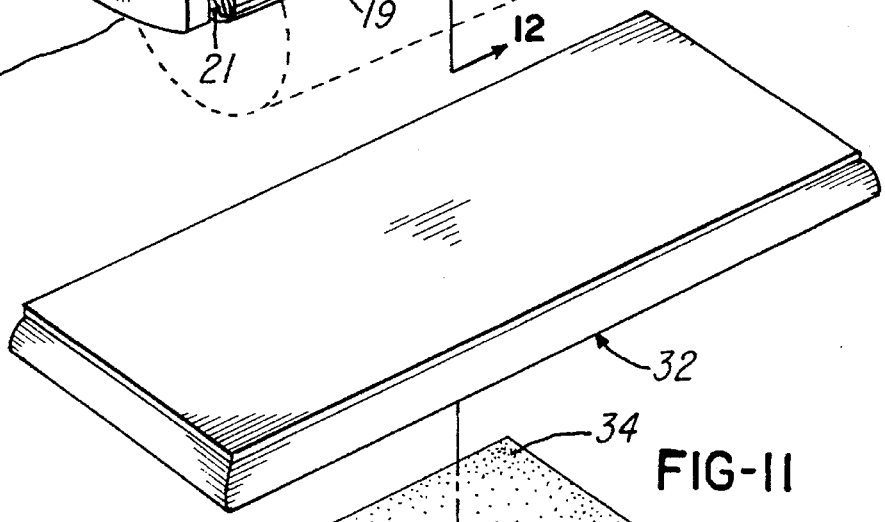

As is apparent from FIGS. 1, 2 and 10, roller (19) accommodates toilet paper roll (20) which is shown in FIGS. 1, 3, 10 and 12.

Figure 3:
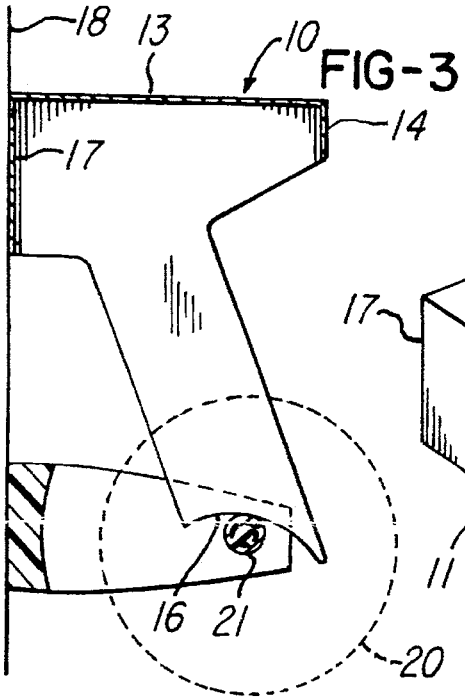
FIG. 3 is sectional view taken along lines 3—3 of FIG. 1.
Figure 4:
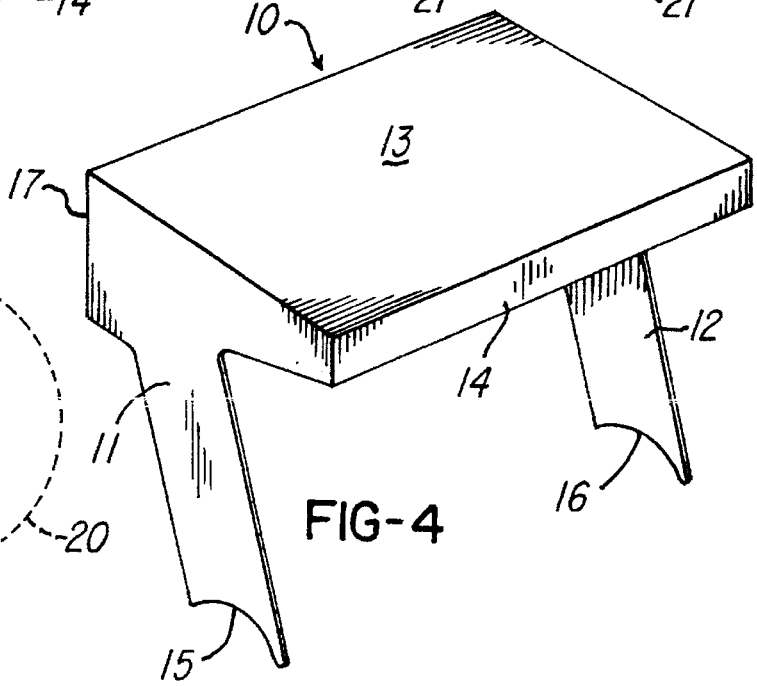
FIG. 4 is a perspective view of the free standing, sheet metal shelf of this invention.

Roller (19) contains reduced side portions (21) upon which self-adjusting arcuate bottom surfaces (15) and (16) rest. This is shown in FIGS. 1, 2 and 3.

FIGS. 5 thru 7, 8 and 9 illustrate the configuration of the sheet metal shelf blank (B), which can be stamped. This stamped blank (FIG. 5) can be folded, and its tabs can be secured by spot welding or gluing, viz., by use of glue or adhesive as is apparent from FIGS. 5, 6 and 7.

Figure 5:
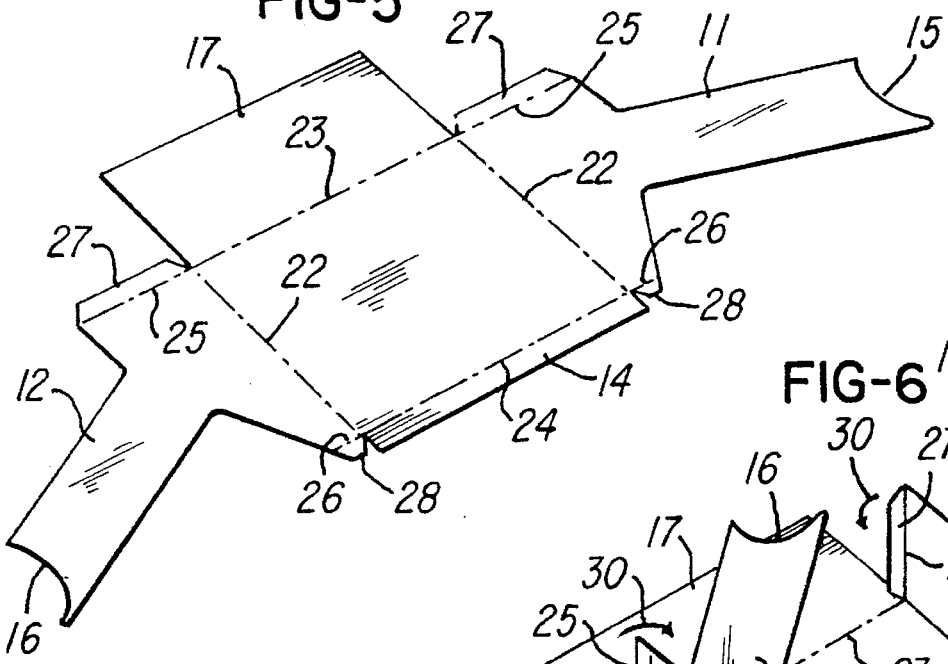
FIG. 5 is a perspective view of a blank configuration from which the shelf is formed, prior to bending.

Fold lines (22) are provided for forming side wall portions (11) and (12). Fold line (23) forms rear wall portion (17) and fold line (24) is provided for forming front wall portion (lip) (14). Fold lines (25) allow for the ready formation of large tabs (ears) (27) as shown in FIGS. 5, 6 and 7 whereas fold lines (26) permit easy formation of small tabs (ears) (28) as is shown in FIGS. 6 and 7.

Figure 8:
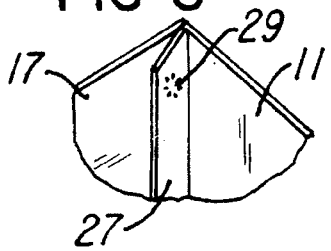
FIG. 8 is an enlarged, fragmentary perspective view showing one optional way of attaching tabs to form the rear wall, e.g. by spot welding.
Figure 9:
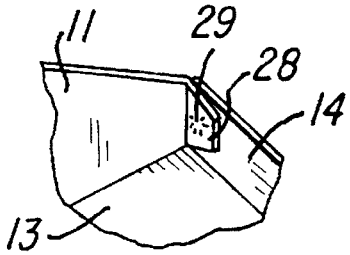
FIG. 9 is a fragmentary perspective view similar to that of FIG. 8 showing connection of tabs to the front wall of the structure.

Spot welds (29) can be employed, for example, to join front wall (14) to sidewall portion(s) (11) and/or (12) as shown in FIGS. 8 and 9.

Figure 6:
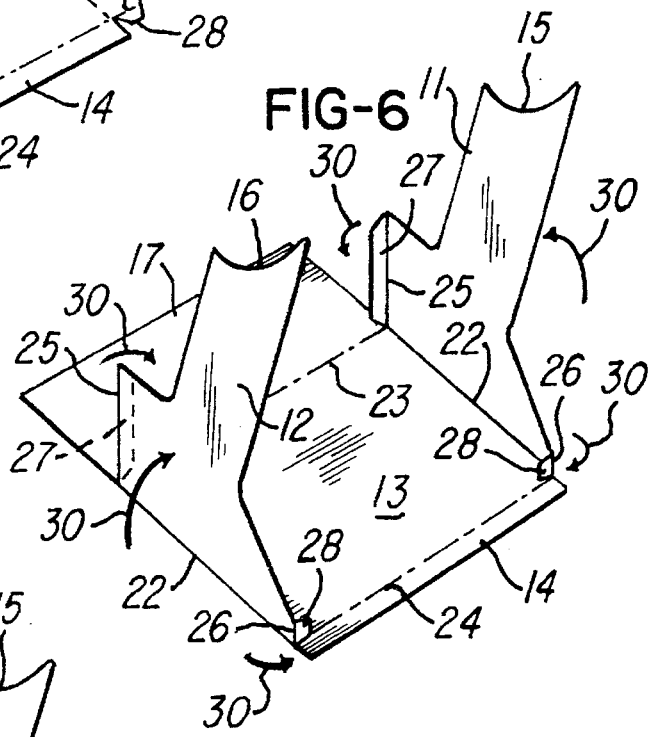
FIG. 6 is a perspective view on the same scale as FIG. 5 showing initial bends resulting in forming side walls and legs.
Figure 7:
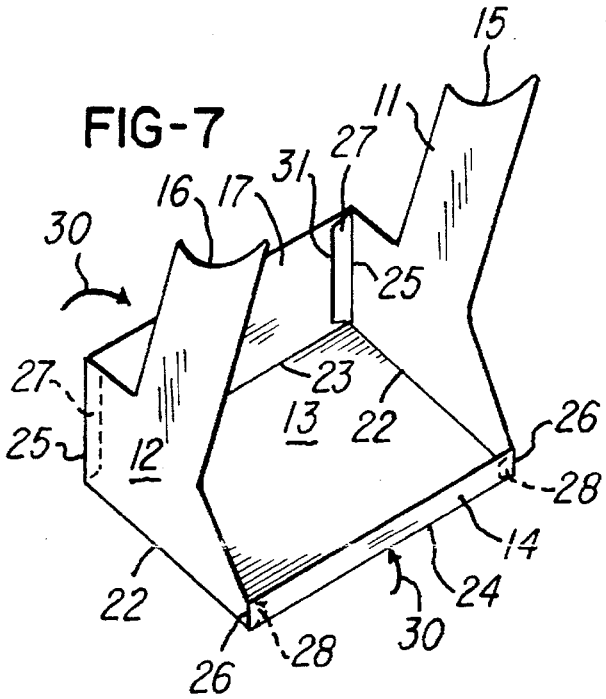
FIG. 7 is a perspective view similar to FIG. 6 showing further final folds.

Arrows (30) indicate an approximate ninety degree (90°) fold or bend and appear in FIGS. 6 and 7. Spot welds (29) glue or adhesive, (31) can be employed to join, for example, tab (27) to rear wall (17).

Figure 11:
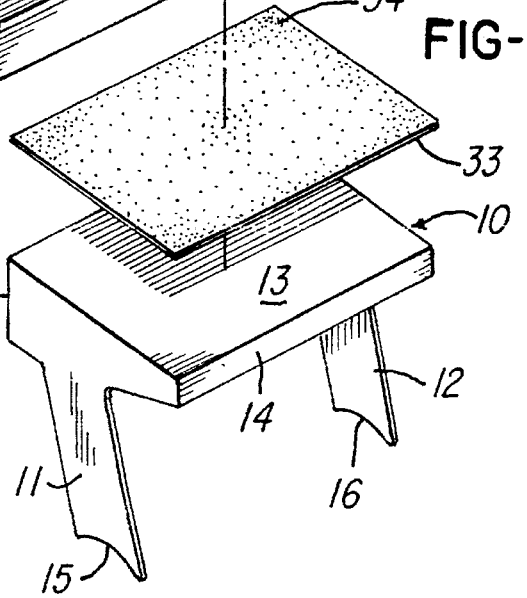
FIG. 11 is an exploded, perspective view of the decorative top shelf of FIG. 10 including a magnet permitting attachment of the decorative shelf to the top surface of the shelf shown in FIGS. 1 thru 9.
Figure 12:
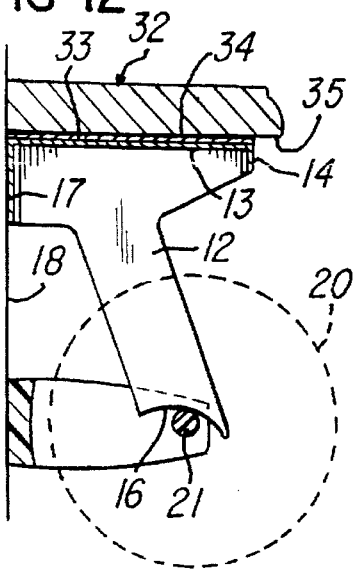
FIG. 12 is a sectional view taken along the lines 12—12 of FIG. 10, and similar to FIG. 3, showing arrangement of parts aligned with respect to a bathroom wall

Sheet metal bathroom shelf (10) can be employed in conjunction with a decorative, aesthetically pleasing shelf top (32), for example, made of wood; and this is shown in FIGS. 10, 11 and 12. A magnet (33) can be employed to assist in joining at least a portion of the bottom surface of the decorative wooden top (32) and the sheet metal shelf (10) as is shown in FIGS. 11 and 12 with the bottom surface of the magnet magnetically bound to the top surface of the sheet metal shelf, which can be magnetic.

Glue or adhesive (34) can be used to adhere the upper surface of magnet (33) to the lower surface of wood shelf (32) as is shown in FIGS. 11 and 12.

In accordance with another embodiment of this invention, as revealed in FIG. 12; the forward most front portion of wood decorative shelf top (32) as indicated in FIG. 12 at (35) can overhang, viz., overlie front wall portion, or lip, (14) of the free standing (unattached) sheet metal shelf (10). This tends to mask from view the front wall (14).

I claim:

1. A free standing sheet metal bathroom shelf, requiring no tools to install instantly, comprising a top portion, a back portion, a front lip portion and a pair of depending support side leg portions terminating in arcuate bottom surfaces, which surfaces permit the sheet metal bathroom shelf to be self adjusting in a position so that its back portion rests against a bathroom wall and is aligned in relation therewith and wherein said arcuate bottom surfaces rest upon reduced side portions of a toilet paper supporting roller.

2. A combination containing a free standing sheet metal bathroom shelf as in claim 1 including a magnet having a bottom surface magnetically bound to the top surface of said sheet metal shelf and its upper surface adhesively secured to at least a portion of the lower surface of an aesthetically pleasing wooden shelf top.

3. A combination as in claim 2 wherein said wooden shelf has a front wall portion which overlies the lip of said free standing sheet metal shelf thus tending to mask from view the front wall of said sheet metal shelf.

* * * * *